US007143558B2

(12) United States Patent
Trotter

(10) Patent No.: US 7,143,558 B2
(45) Date of Patent: Dec. 5, 2006

(54) DRYING SYSTEM FOR STRUCTURAL WATERPROOFING

(76) Inventor: Robert Michael Trotter, 2614 Chestnut Dr., North, Atlanta, GA (US) 30360

( * ) Notice: Subject to any disclaimer, the term of this patent is extended or adjusted under 35 U.S.C. 154(b) by 0 days.

(21) Appl. No.: 10/666,500

(22) Filed: Sep. 19, 2003

(65) Prior Publication Data

US 2004/0139688 A1 Jul. 22, 2004

Related U.S. Application Data

(60) Provisional application No. 60/442,147, filed on Jan. 22, 2003.

(51) Int. Cl.
*E04B 1/70* (2006.01)

(52) U.S. Cl. ..... 52/302.1

(58) Field of Classification Search ..... 52/302.1, 52/302.3, 169.5, 294
See application file for complete search history.

(56) References Cited

U.S. PATENT DOCUMENTS 3,975,467 A * 8/1976 Beck ..... 261/30
4,185,429 A * 1/1980 Mendola ..... 52/274
4,295,415 A * 10/1981 Schneider, Jr. ..... 454/185
4,578,912 A * 4/1986 Ericsson ..... 52/169.5
4,590,722 A * 5/1986 Bevelacqua ..... 52/302.3
4,660,333 A * 4/1987 Romer ..... 52/302.3
4,798,034 A 1/1989 Jarnagin et al.
4,843,786 A * 7/1989 Walkinshaw et al. ..... 52/169.5
4,949,626 A * 8/1990 Townsend et al. ..... 454/341
5,107,642 A * 4/1992 Mogstad ..... 52/169.5
5,277,003 A 1/1994 Myers
5,474,400 A 12/1995 Kliefoth et al.
5,501,044 A * 3/1996 Janesky ..... 52/169.5
5,526,621 A * 6/1996 Shelton ..... 52/302.1
5,694,723 A * 12/1997 Parker ..... 52/169.5
5,761,864 A * 6/1998 Nonoshita ..... 52/302.3
6,061,978 A * 5/2000 Dinwoodie et al. ..... 52/173.3
6,279,279 B1 * 8/2001 Larimore ..... 52/302.1
6,543,189 B1 * 4/2003 Wood et al. ..... 52/169.14
6,706,096 B1 * 3/2004 Sanglerat et al. ..... 95/274
2002/0073628 A1 * 6/2002 Dextras ..... 52/1
2002/0152696 A1 * 10/2002 Ruiz et al. ..... 52/169.5
2003/0115814 A1 * 6/2003 Nielsen ..... 52/302.1
2003/0126806 A1 * 7/2003 Ellis ..... 52/95

OTHER PUBLICATIONS

U.S. Appl. No. 10/347,652, filed Jan. 2003, DiCello.*
International Search Report.

* cited by examiner

*Primary Examiner*—Sarah Purol
(74) *Attorney, Agent, or Firm*—Troutman Sanders LLP; Gerald R. Boss

(57) ABSTRACT

A drying system for structural waterproofing of an enclosure includes a drainage conduit for draining water from the enclosure. The drainage conduit has a periphery defining an interior and an air inlet and air outlet. An air circulator circulates air between the air inlet and the air outlet throughout the interior of the drainage conduit such that the circulated air removes moisture and gas from the conduit's interior through the air outlet.

15 Claims, 2 Drawing Sheets

DRYING SYSTEM FOR STRUCTURAL WATERPROOFING

This application claims priority from Provisional Patent Application Ser. No. 60/442,147 filed Jan. 22, 2002, entitled "Drying System for Structural Waterproofing."

BACKGROUND OF THE INVENTION

1. Field of the Invention

The present invention relates generally to relieving and eliminating water problems associated with the exterior and interior of an enclosure's foundation and, more particularly, to an apparatus and method for drying an existing or newly installed structural waterproofing system.

2. Description of the Related Art

The foundations of buildings often experience water problems due to a variety of causes. When such foundations are constructed, the surrounding soil must be removed prior to construction and then replaced after the foundation is completed. As a result, foundations can become damaged as soil settles outside of the foundation. Furthermore, a negative grade sloping toward the foundation is also often formed due to such settling. With the negative grade, the force of gravity causes water to move toward the foundation cracking the foundation and eventually entering into the building. This is especially true of basements and crawl spaces. When water enters a dwelling, many problems arise, both to the physical structure of the dwelling and to the air.

It is known in the art to install structural waterproofing systems to drain water from basements and crawl spaces. Typical waterproofing systems include some method of draining the water from inside the building to the outside. U.S. Pat. No. 4,798,034 discloses a basement draining channel that extends around the periphery of a basement floor, next to the wall, for draining away collected water. The channel includes a plurality of drain entrance holes leading to drain tubes. When water enters the basement walls, it is collected in the channel and directed toward the entrance holes due to gravity. The water is channeled via gravity to a drain connector pipe to a sump pump. To prevent radon from entering into the basement of the dwelling the draining channel is sealed. A venting pipe extends upwardly from the top of the baseboard for venting radon gas outside of the dwelling.

The problem with such existing gravity-based waterproofing systems, however, is that the system must absorb a certain amount of water before the water will flow, and ultimately drain from the structure. If there is too little water to cause flow, the water remains stagnant and evaporates back into the interior of the basement causing mildew, mold, and general dampness. Also when a sufficient amount of water is present to create a flow, a residual amount of water is left in the conduit when the flow stops. Additionally, any water drained directly beneath the floor of the basement may evaporate back into the waterproofing system and eventually back into the basement.

Dampness and associated mold from such evaporation causes damage to buildings, ruins possessions, produces foul odors, and even presents potential health problems. When excessive moisture or water accumulates indoors, growing molds produce allergens, irritants, and potentially toxic substances. Although mold growth can be treated, it cannot be eliminated as long as a moisture problem exists. Thus, there is a need in the art for a drying system for a waterproofing system that removes moisture from the waterproofing system.

Another problem associated with basements and crawl spaces is the effect of radon. Radon is a colorless, radioactive gas that can be extremely toxic. The Environmental Protection Agency and the National Cancer Institute presently estimate that about 15,000 lung cancer deaths are caused by radon each year in the United States alone. Radon gas may be in the soil surrounding the structure and can seep into the interior of basements and crawl spaces through cracks in the foundation and even through the structural waterproofing system itself.

It is generally known in the art to vent radon from a structural water proofing system. Representative patents of waterproofing systems include U.S. Pat. Nos. 4,798,034 and 5,474,400 describing devices and methods for venting radon from waterproofing systems that are sealed off from the interior of the building. A gas venting pipe is connected to each system for suctioning radon gas with a fan and venting it to the outside. Because these systems are sealed, however, they do not address the problem of removing fluids and associated moisture from the inside of a structure, such as a basement or crawl space. Furthermore, neither discuss removing water vapor from the waterproofing system.

Other techniques have been proposed for eliminating radon from interior waterproofing systems. One such technique is disclosed in U.S. Pat. No. 5,277,003 incorporating a radon blockage means, such as a water-filled trap or a one-way valve, into an interior waterproofing system to prevent radon from entering a home. Any radon gas below the blockage means is evacuated from the waterproofing system through a chimney or the use of a vacuum-type fan. Although such a technique may prevent radon from entering a structure, it would not be sufficient to simultaneously dry the waterproofing system through the venting of water particles. Moreover, the use of a water-filled trap as the radon blockage means would provide a supply of standing water for evaporation back into the home.

What is needed then is a drying system for structural waterproofing that will remove standing water particles from the waterproofing system, thus, preventing moisture in the system from evaporating back inside the structure while having the secondary effect of removing harmful radon gas.

SUMMARY OF THE INVENTION

A drying system for structural waterproofing of an enclosure includes a drainage conduit for draining water from the enclosure. The drainage conduit has a periphery defining an interior and an air inlet and air outlet. An air circulator circulates air between the air inlet and the air outlet throughout the interior of the drainage conduit such that the circulated air removes moisture and gas from the conduit's interior through the air outlet.

DETAILED DESCRIPTION OF THE PREFERRED EMBODIMENTS

The invention is a drying system for a structural waterproofing system. The drying system is preferably used to dry a waterproofing system installed in the interior of a basement or crawlspace. The drying system removes moist air from the basement or crawl space and has the added benefit of removing radon or other harmful gases that may be present as well. The drying system can be applied to any existing waterproofing system or can be utilized with a newly installed system.

Figure 1:
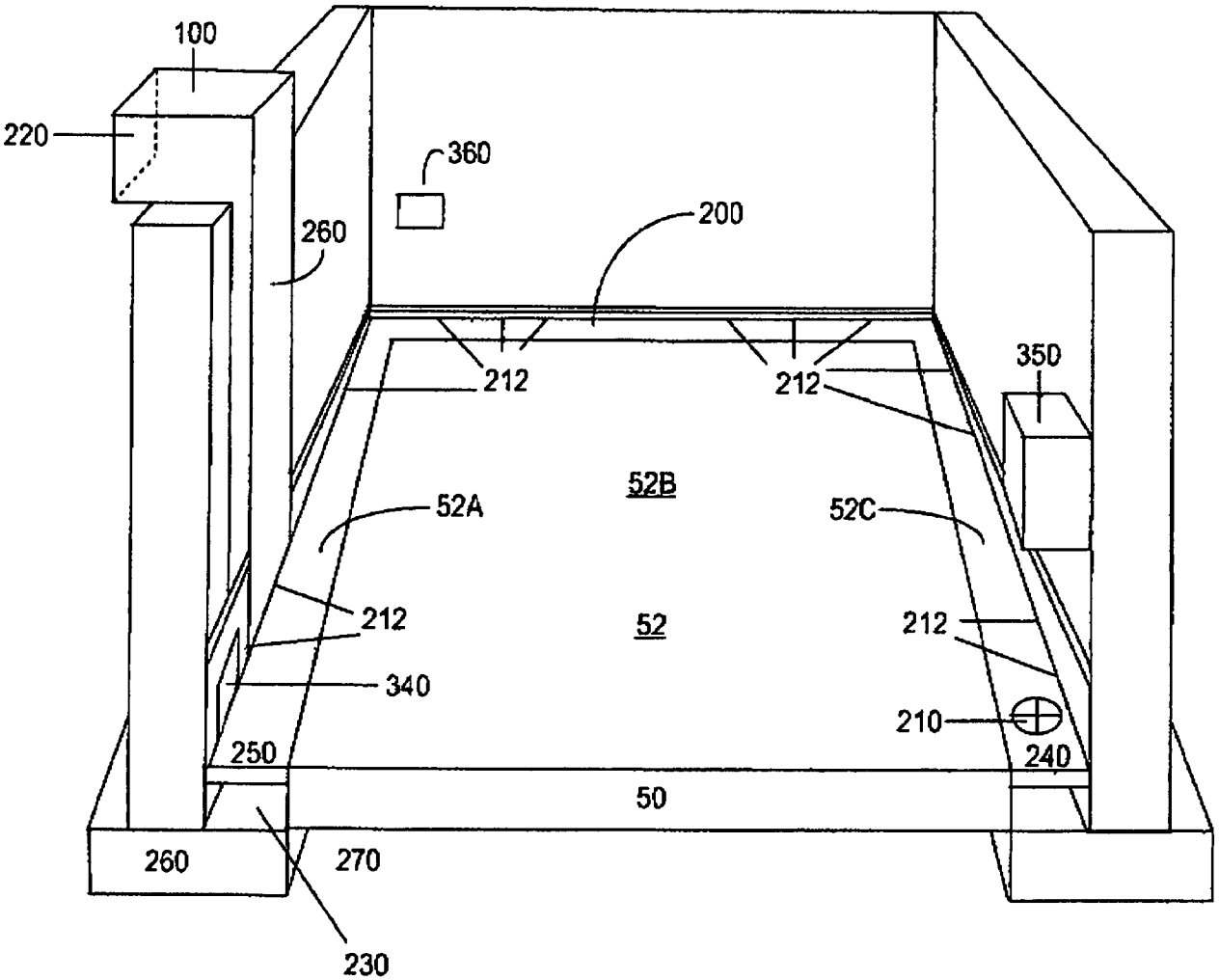
FIG. 1 is a perspective view of a preferred embodiment of present invention.

Referring now in derail to the drawing figures, wherein like reference numerals represent like pans. FIG. 1 illustrates a perspective view of a preferred embodiment of the present invention. The drying system comprises an air circulator 100 for moving air throughout the structure and a drainage member 200. The air circulator 100 communicates with the drainage member and moves air and water from the structure and through drainage member 200, such that water and associated moisture are removed from the interior of the structure to the outside. The drainage member comprises at least one air inlet 210 communicating with at least one air outlet 220, and a drainage conduit 230.

Drainage member 200 and drainage conduit 230 are pan of a typical waterproofing system within an enclosure such as a basement. The typical basement has four walls and a sub-floor 50. Drainage member 200 is built into an existing sub-floor 50 forming the periphery of drainage conduit 230. Floor 52 consisting of elements 52A, 52B and 52C extends across the basement. Drainage conduit 230 preferably extends along the entire perimeter of the basement, underneath the floor 52, in communication with foundation element 260 and soil 270 within a crawl space. However, other drainage conduit lengths and configurations may be had depending on the water problems affecting the basement. Drainage conduit 230 includes an interior which entraps water entering into the basement and drains the water via water flow to either a gravity drain or a sump. A plurality of drains may exist in connection with the gravity drain or sump. Typical water proofing systems are well known in the art. To capture water which may seep downward from the basement walls above drainage member 200, the water proofing system may include a plurality of wall openings 212 along the drainage member 200 enabling water to enter into drainage conduit 230.

To facilitate in the removal of moisture and water vapor from drainage conduit 230, air is circulated throughout the length of drainage conduit 230. By circulating air throughout the drainage conduit, the water vapor is removed, enabling the liquid water to experience a phase shift into becoming water vapor which is then subsequently removed. This facilitates the drying of the waterproofing system. For example, if the temperature of water is 25 degrees Celsius, the liquid water tries to maintain sufficient water vapor in contact with it to maintain a pressure of 25 mm of mercury. When air removes the water vapor away, the liquid water re-establishes the 25 mm of mercury by evaporating more liquid and hence increases the rate of evaporation. By providing moving air throughout the drainage conduit, the water vapor and water standing in the drainage conduit are removed.

The air utilized to circulate through drainage conduit 230 originates outside drainage conduit 230. With the water and water vapor inside of drainage conduit 230, the humidity of the air inside drainage conduit 230 is generally higher than the air inside the basement. As shown in FIG. 1, in one embodiment of the invention, air from the dwelling or basement is drawn into the drainage conduit via air inlet 210. Air inlet 210 is preferably located at a remote end 240 of drainage conduit 230. At an opposing end 250 of drainage conduit 230 an air outlet 220 enables the drawn air and associated water vapor to be drawn away from drainage conduit 230. Preferably, vent 260 vents the drawn air and associated water vapor outside the dwelling. Air circulator 100 draws the air and water vapor through drainage conduit 230. Preferably air circulator 100 is a fan or vacuum having sufficient drawing strength for drawing air from the basement through air inlet 210, through the entire length of drainage conduit 230 and through vent 260. The operating capacity of air circulator 100 will depend upon the overall size of waterproofing system A. Also, if waterproofing system A includes a plurality of wall openings 212, air circulator 100 will also require sufficient operating capacity to ensure that air is drawn from the basement through air inlet 210.

In operation, with the air in the basement being drier than the air in the waterproofing system, the air in the basement is utilized for transporting water vapor from the interior of the waterproofing system facilitating in rapid drying of the interior of the waterproofing system. By locating an air inlet in the proximity of a remote first end of the waterproofing system and an air outlet in the proximity of an opposing second end of the waterproofing system, the entire interior of the waterproofing system experiences the air circulation. Additionally, air is circulated throughout the dwelling by circulating the air within the basement outside which further reduces any moisture build up within the basement from the presence of water.

Figure 2:
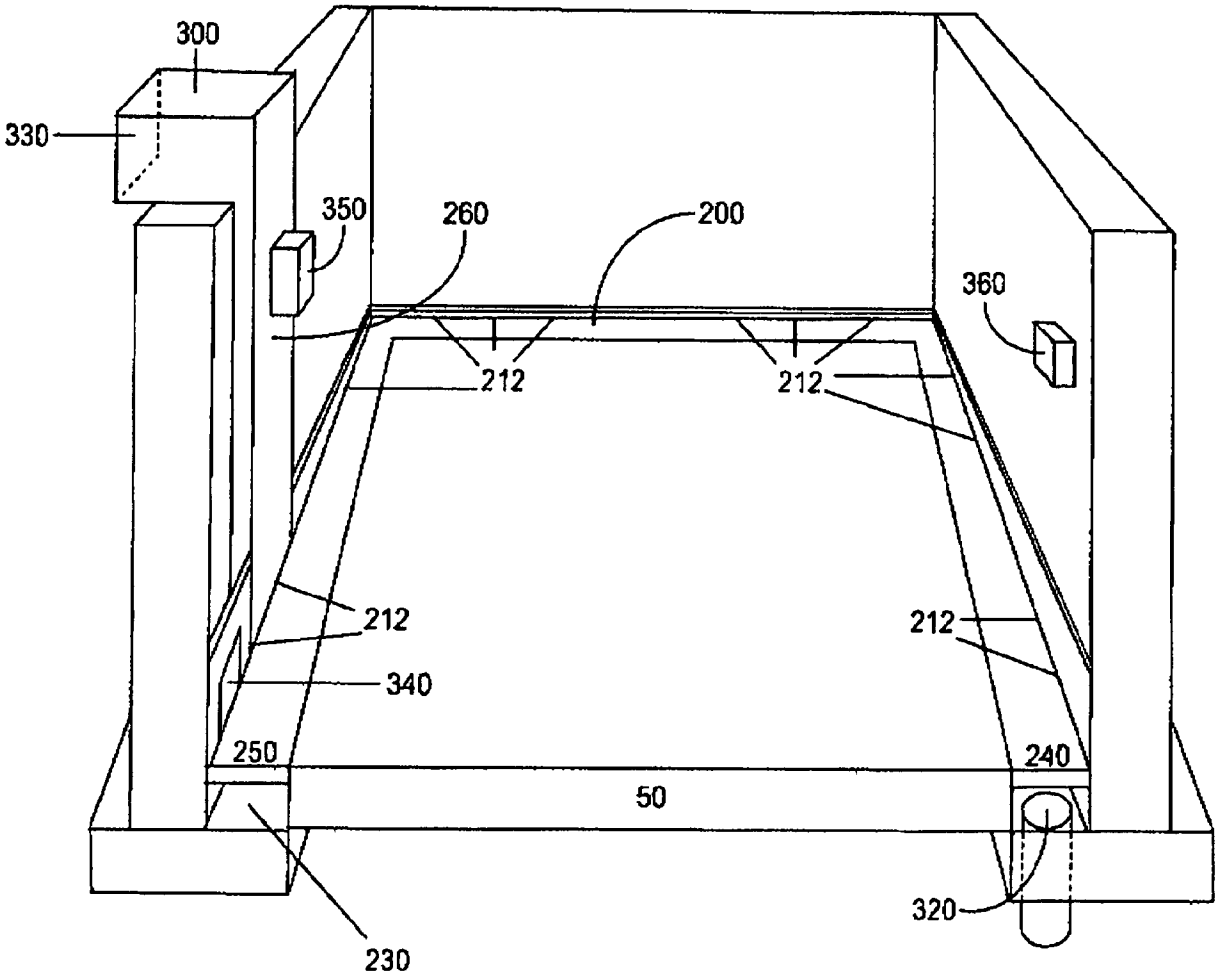
FIG. 2 is an alternative embodiment of the invention.

As shown in FIG. 2, in a second embodiment of the invention, the same construction of waterproofing system exists with the exception that air outlet 320 is a drain which leads to either a gravity drain or sump and air circulator 300 is a blower blowing cider air throughout the length of drainage conduit 230. In this embodiment prior air outlet 220 becomes air inlet 330. In ibis embodiment, the drying of waterproofing system is achieved in the same manner. Namely, drier air is introduced into the interior of drainage conduit 230 and passes throughout the entire length of drainage conduit 230 enabling water vapor to be expelled outside the interior of drainage conduit 230. By utilizing air which is outside drainage conduit 230, the air's humidity is lower than thus in the drainage conduit which facilitates in the evaporation of the water inside the drainage conduit which is unable to flow to a gravity drain.

Drying system may also include a humidistat 340 for sensing the amount of moisture in the drainage conduit. Humidistat 340 may be coupled to air circulator 100 or 300 for activating air circulator 100 or 300 when a certain level of water vapor within drainage conduit 230 is detected. Also a dehumidifier 350 may be located proximal to air inlet 220 or 330 to ensure that the air which is circulated within drainage conduit 230 is dried to a desired amount to facilitate in the removal of the water vapor from drainage conduit 230. Finally, a timer 360 may be utilized for programming the air circulator 100 or 300.

Accordingly, it may be seen, that a simple solution may be had for removing water vapor and stagnant water from a waterproofing system by utilizing dry air circulated throughout the length of the waterproofing system.

What is claimed is:

1. A foundation waterproofing system, the system comprising:

a waterproofing system including a conduit or open space for receiving and communicating water away from the foundation of a structure;

said conduit or open space having a bottom which is defined by said foundation of said structure;

an air inlet in communication with said waterproofing system for communicating air through said waterproofing system's open space or conduit, and to the foundation and soil in the area proximate to said foundation;

an air outlet in fluid communication with said waterproofing system's conduit;

an air circulator for circulating air between said air inlet and said air outlet throughout said waterproofing system's open space or conduit; and wherein the circulated air removes moisture and gas from said proximate soil area, said foundation and also from said waterproofing system through said air outlet.

2. A drying system for a structural waterproofing a structure having a floor and at least one wall, said wall resting on a foundation, the drying system comprising:

a waterproofing system's open space or conduit for draining water below the floor of said structure, said waterproofing system's open space or conduit having a periphery defining an interior, said periphery having a bottom defined by said foundation;

said waterproofing system's open space or conduit located underneath the floor of said structure at the subfloor area in the proximity of the location where said wall rests on said foundation;

an air inlet in fluid communication with said interior of said waterproofing system's open space or conduit;

an air outlet in fluid communication with said waterproofing system's open space or conduit;

an air circulator for circulating air between said air inlet and said air outlet throughout waterproofing system's open space or conduit; and wherein the circulated air removes moisture and gas from said waterproofing system's open space or conduit, foundation and adjacent sub floor soil and exits through said air outlet.

3. The drying system of claim 2 wherein said air inlet is in communication with the interior of said structure and air is drawn from the interior of said structure by said air circulator into said waterproofing system's open space or conduit and to the foundation and soil in the area proximate to said foundation.

4. The drying system of claim 2 wherein said waterproofing system's open space or conduit has a remote first end and an opposing second end, said air inlet located in the proximity of said remote first end of said waterproofing system's open space or conduit and said air outlet located in the proximity of said opposing second end of said waterproofing system's open space or conduit wherein air is circulated throughout said interior of said waterproofing system's open space or conduit and to the foundation and soil in the area proximate to said foundation.

5. The drying system of claim 2 further comprising an air duct having first and second ends, wherein said first end communicates with said air outlet of said waterproofing system's open space or conduit and said second end communicates with the exterior of said structure.

6. The drying system of claim 5, wherein said air circulator is located proximal to said second end of said air duct and said air circulator draws air from said interior of said enclosure through said waterproofing system's open space or conduit.

7. The drying system of claim 2 , wherein said air circulator is a fan.

8. The drying system of claim 2 further comprising a dehumidifier for dehumidifying the air circulated by said air circulator.

9. The drying system of claim 2 further comprising a humidistat for sensing the amount of moisture in said waterproofing system's open space or conduit or said enclosure, said humidistat activating the operation of said air circulator.

10. The drying system of claim 2 further comprising a timer for programming the operation of said air circulator.

11. A method for drying a structural waterproofing system of a structure having a floor and at least one wall ,said wall resting on a foundation, the structural waterproofing system located in the proximity of said foundation, the method comprising the steps of:

an air circulator in fluid communication with said structural waterproofing system; and circulating air throughout said structural waterproofing system's open space or conduit, foundation and adjacent sub floor soil and removing moisture and gas from underneath the floor of said structure via said waterproofing system, wherein moisture is transported away from said waterproofing system and the foundation and proximate soil.

12. A foundation waterproofing system for a structure having a floor and a wall resting on a foundation, the system comprising:

a waterproofing system including an open space or conduit having a general periphery for receiving and communicating water away from the foundation of a structure;

said foundation defining a bottom of said open space or conduit;

an air inlet in communication with said waterproofing system for communicating air through said waterproofing system's open space or conduit such that said air is in contact with said foundation;

an air outlet in fluid communication with said waterproofing system's open space or conduit;

an air circulator for circulating air between said air inlet and said air outlet throughout said waterproofing system's open space or conduit ; and wherein the circulated air removes moisture from said foundation and also from said waterproofing system through said air outlet.

13. The foundation waterproofing system of claim 12 wherein said wall of said structure defines a side of said open space or conduit.

14. The foundation waterproofing system of claim 13 including a horizontal top for defining a top side of said open space or conduit, said horizontal top being generally level with said floor of the structure.

15. The foundation waterproofing system of claim 14 including a conduit wall offset from said wall which in combination with said wall, foundation, and horizontal top define a generally enclosed conduit or open space and wherein said circulated air removes moisture from said conduit or open space and said foundation.

* * * * *